US009427082B2

(12) United States Patent
Marrero

(10) Patent No.: US 9,427,082 B2
(45) Date of Patent: Aug. 30, 2016

(54) ROTATING STORAGE CABINET FOR CORNER INSTALLATION

(71) Applicant: Cabinet Storage Solutions, Inc., Hialeah, FL (US)

(72) Inventor: Lysander M. Marrero, Hialeah, FL (US)

( * ) Notice: Subject to any disclaimer, the term of this patent is extended or adjusted under 35 U.S.C. 154(b) by 0 days.

(21) Appl. No.: 14/597,060

(22) Filed: Jan. 14, 2015

(65) Prior Publication Data

US 2016/0198844 A1 Jul. 14, 2016

(51) Int. Cl.
*A47B 81/00* (2006.01)
*A47B 49/00* (2006.01)

(52) U.S. Cl.
CPC ..... *A47B 49/006* (2013.01); *A47B 49/004* (2013.01)

(58) Field of Classification Search
CPC A47B 49/004; A47B 49/006; A47B 63/062; A47F 3/10; A47F 5/02
USPC ..... 312/305, 125, 135, 238, 267; 211/144, 211/163; 108/22, 103, 139
See application file for complete search history.

(56) References Cited

U.S. PATENT DOCUMENTS 503,306 A * 8/1893 Bever ..... A47B 67/04 312/125
760,278 A * 5/1904 Thurman ..... A47B 49/004 312/202
827,761 A * 8/1906 Stromgren ..... A47B 49/00 312/197
1,325,585 A * 12/1919 Schmidt ..... F25D 23/087 312/296
1,386,500 A 8/1921 Hile
1,422,845 A * 7/1922 Franks ..... A47F 5/04 211/163
1,559,705 A * 11/1925 Jackson ..... A47B 49/004 211/77
2,608,457 A 8/1952 Zibell
3,596,077 A * 7/1971 Miazga ..... A47B 49/00 211/34
3,807,826 A * 4/1974 Peckenpaugh ..... A47B 53/00 312/242
4,239,311 A * 12/1980 Brownlee ..... A47B 63/062 108/139
4,324,076 A * 4/1982 Honickman ..... A47B 47/021 108/107
4,440,459 A 4/1984 Hallgren
4,631,894 A * 12/1986 Jerila ..... E04C 2/384 52/241
4,738,495 A 4/1988 Mitts
4,998,388 A * 3/1991 Englehart ..... A47B 47/05 52/36.1
5,152,592 A 10/1992 Krayer
5,524,775 A 6/1996 Kaine
6,378,964 B2 4/2002 Robbins
6,508,021 B2 * 1/2003 Ong ..... G11B 33/0483 211/163
6,523,917 B2 2/2003 Twellmann
6,626,305 B2 9/2003 Domenig
8,020,951 B2 9/2011 Twellmann
8,074,812 B1 12/2011 Bradbury
8,083,303 B2 12/2011 Compagnucci
8,246,127 B1 8/2012 Clausen
8,511,487 B2 * 8/2013 Andersen ..... A47B 49/004 211/144

(Continued)

*Primary Examiner* — Janet M Wilkens
(74) *Attorney, Agent, or Firm* — IDP Patent Services; Olav M. Underdal

(57) ABSTRACT

A rotating storage cabinet for corner installation includes: an inner cabinet, further including a bottom inner mounting plate, a first t-frame, a second t-frame, and a top inner mounting plate; upper and lower swivels; and a cabinet enclosure, further including a base enclosure board, a right side column, a left side column, a rear column, and a top enclosure board; such that the inner cabinet is rotationally mounted inside the cabinet enclosure, with a central cavity for storage between the t-frames, including a clothing bar and drawers, and shelves mounted on outer sides of the t-frames. Additionally, the rotating storage cabinet can be installed without a cabinet enclosure, directly between a ceiling and a floor.

19 Claims, 11 Drawing Sheets

(56) References Cited

U.S. PATENT DOCUMENTS

2008/0231155 A1* 9/2008 Shen ..... A47B 88/04
312/334.8

2012/0306335 A1* 12/2012 Herreid, II ..... A47B 81/002
312/238

* cited by examiner

Rotating Storage Cabinet

Opposing T-Frames

Base Enclosure Board

Top/Bottom Inner Mounting Plate

Shelves

ROTATING STORAGE CABINET FOR CORNER INSTALLATION

CROSS-REFERENCE TO RELATED APPLICATIONS

N/A

FIELD OF THE INVENTION

The present invention relates generally to the field of corner cabinets, and more particularly to devices and designs for rotating corner cabinets with enhanced storage space.

BACKGROUND OF THE INVENTION

Many different designs are used for storage cabinets in order to provide efficient space utilization to store clothing and household items.

Rotating corner cabinets, particularly for use in kitchens, are well known. However, such cabinets are usually small and feature spaces centered around a central spindle. Such rotating corner cabinets are well adapted to storing kitchen related household items, but do not provide space adequate for storing larger items, and particularly do not provide any useful space for hanging clothing, drawers, and other longer and/or larger items.

As such, considering the foregoing, it may be appreciated that there continues to be a need for novel and improved devices and methods for rotating storage cabinets that provide storage space for clothing, drawers and other larger items.

SUMMARY OF THE INVENTION

The foregoing needs are met, to a great extent, by the present invention, wherein in aspects of this invention, enhancements are provided to the existing designs for rotating storage cabinets, to provide improved space utilization.

In an aspect, a rotating storage cabinet for corner installation can include two main cabinet parts: a fixed cabinet enclosure, and an inner cabinet, which rotates inside the fixed cabinet enclosure. The inside unit can use side-mounted vertical support columns in a double-t design, which creates an interior elongated storage space, suitable for hanging clothes or storing other larger items, with shelves mounted on the other sides of the vertical support columns.

In a related aspect, the inner cabinet rotates 360 degrees with the inner cabinet rotationally attached to the fixed cabinet enclosure using top and bottom mounted swivels.

There has thus been outlined, rather broadly, certain embodiments of the invention in order that the detailed description thereof herein may be better understood, and in order that the present contribution to the art may be better appreciated. There are, of course, additional embodiments of the invention that will be described below and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of embodiments in addition to those described and of being practiced and carried out in various ways. In addition, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

DETAILED DESCRIPTION

Figure 1:
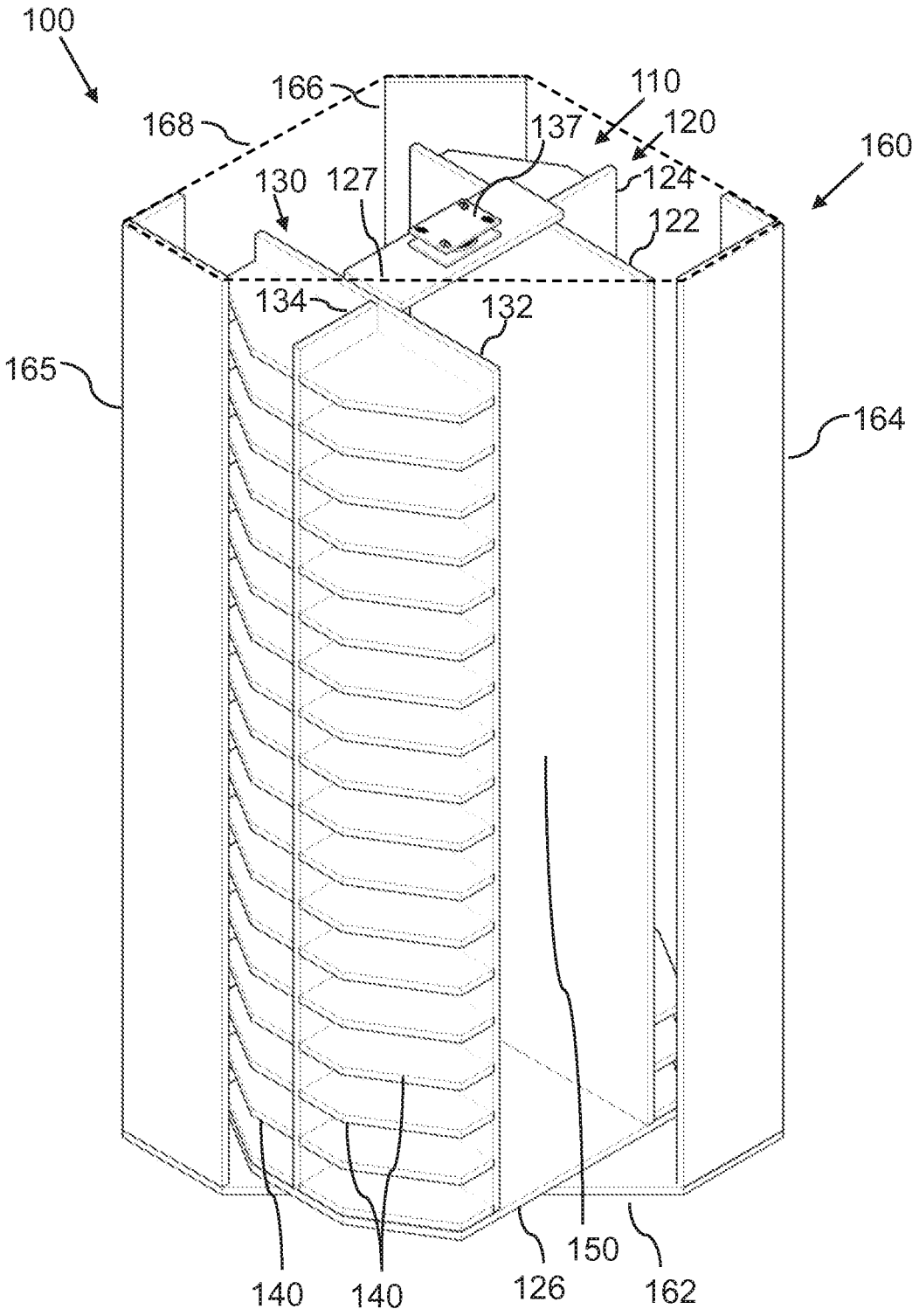
FIG. 1 shows a front isometric view of a rotating storage cabinet for corner installation, according to an embodiment of the invention.

Before describing the invention in detail, it should be observed that the present invention resides primarily in a novel and non-obvious combination of elements and process steps. So as not to obscure the disclosure with details that will readily be apparent to those skilled in the art, certain conventional elements and steps have been presented with lesser detail, while the drawings and specification describe in greater detail other elements and steps pertinent to understanding the invention.

The following embodiments are not intended to define limits as to the structure or method of the invention, but only to provide exemplary constructions. The embodiments are permissive rather than mandatory and illustrative rather than exhaustive.

In the following, we describe the structure of an embodiment of a rotating storage cabinet for corner installation 100 with reference to FIG. 1, in such manner that like reference numerals refer to like components throughout; a convention that we shall employ for the remainder of this specification.

Figure 8:
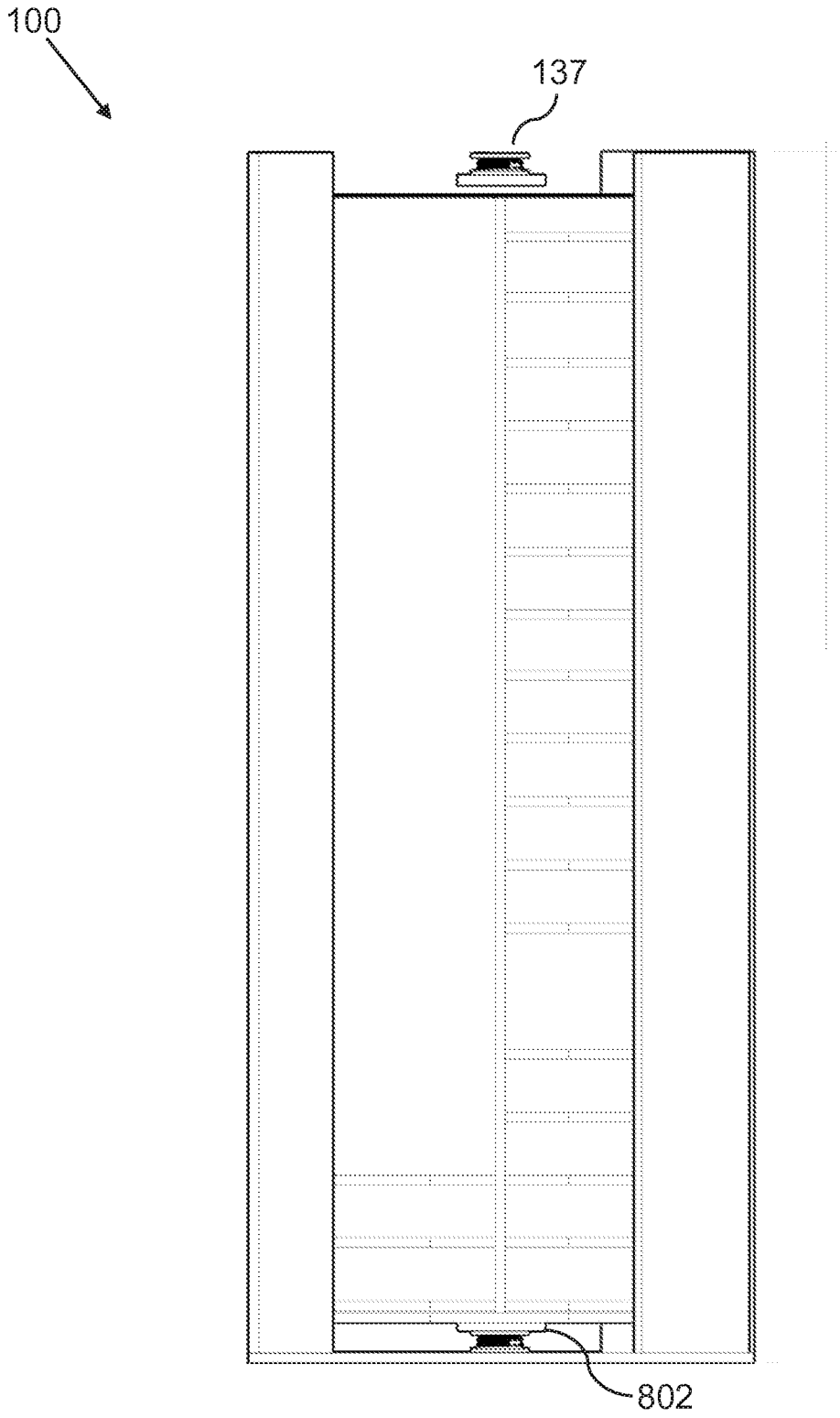
FIG. 8 shows a side view of a rotating storage cabinet for corner installation, according to an embodiment of the invention.

In an embodiment, a rotating storage cabinet for corner installation 100 can include:

a) An inner cabinet 110; further including:

i. A bottom inner mounting plate 126;

ii. A first t-frame 120; which is connected on top of a first side of the bottom inner mounting plate 126, such that the first t-frame 120 forms a vertical support column, and the first t-frame 120 further comprises:

1. an inward-facing first t-plate 122, connected with
2. an outward-facing first t-leg 124;

iii. A second t-frame 130, which is connected on second side of the top of the bottom inner mounting plate 126, such that it forms a vertical support column, and the first t-frame 120 further includes:

1. an inward-facing second t-plate 132, connected with
2. an outward-facing second t-leg 134;

such that the first and second t-frames are opposing with the outer surfaces of the respective t-plates parallel and facing each other, with a predetermined width, such that a vertical and elongated central cavity 150 is created between the opposing t-plates 122 132;

iv. A top inner mounting plate 127; which is connected to the top of the first and second t-frames 120 130, such that first and second t-frames are stabilized in position between the bottom inner mounting plate 126 and the top inner mounting plate 127; and b) A cabinet enclosure 160; further including:

i. A base enclosure board 162, ii. A support structure, which can further include:

1. A right side column 164, which can be a vertically elongated I-shaped plate;
2. A left side column 165, which can be a vertically elongated rectangular plate;
3. A rear column 166, which can be a vertically elongated rectangular plate;

iii. A top enclosure board 168 (In FIG. 1, shown transparent, in dotted lines);

wherein:

the right side column 164, is vertically mounted between a right side of the base enclosure board 162 and a right side of the top enclosure board 168;

the left side column 165, is vertically mounted between a left side of the base enclosure board 162 and a left side of the top enclosure board 168; and the rear column 166 is vertically mounted between a rear side of the base enclosure board 162 and a rear side of the top enclosure board 168;

such that:

The inner cabinet 110 is rotationally mounted inside the cabinet enclosure, via the upper swivel 137, mounted between the top enclosure board and the top inner mounting plate 127, and a lower swivel 802, shown on FIG. 8, mounted between the bottom inner mounting plate 126 and the base enclosure board 162.

In a related embodiment, shelves 140 can be mounted on the first and second t-frames 120 130, such that the shelves 140 are mounted on outer sides of the t-frame 120 130, in outward facing spaces between the t-plates 122 132 and the t-legs 124 134.

In related embodiments, a rotating storage cabinet 100 can be installed in a cabinet enclosure, wherein the cabinet enclosure can be configured according to a plurality of designs, which can include designs without a top enclosure board and/or a base enclosure board, and with support structure configured according to a plurality of different designs.

In a related embodiment, a rotating storage cabinet 100 can be installed without a cabinet enclosure, directly between a ceiling and a floor, such that the upper swivel 137 is mounted between the ceiling and the top inner mounting plate 127, and the lower swivel 802 is mounted between the floor and the base enclosure board 162.

Figure 2:
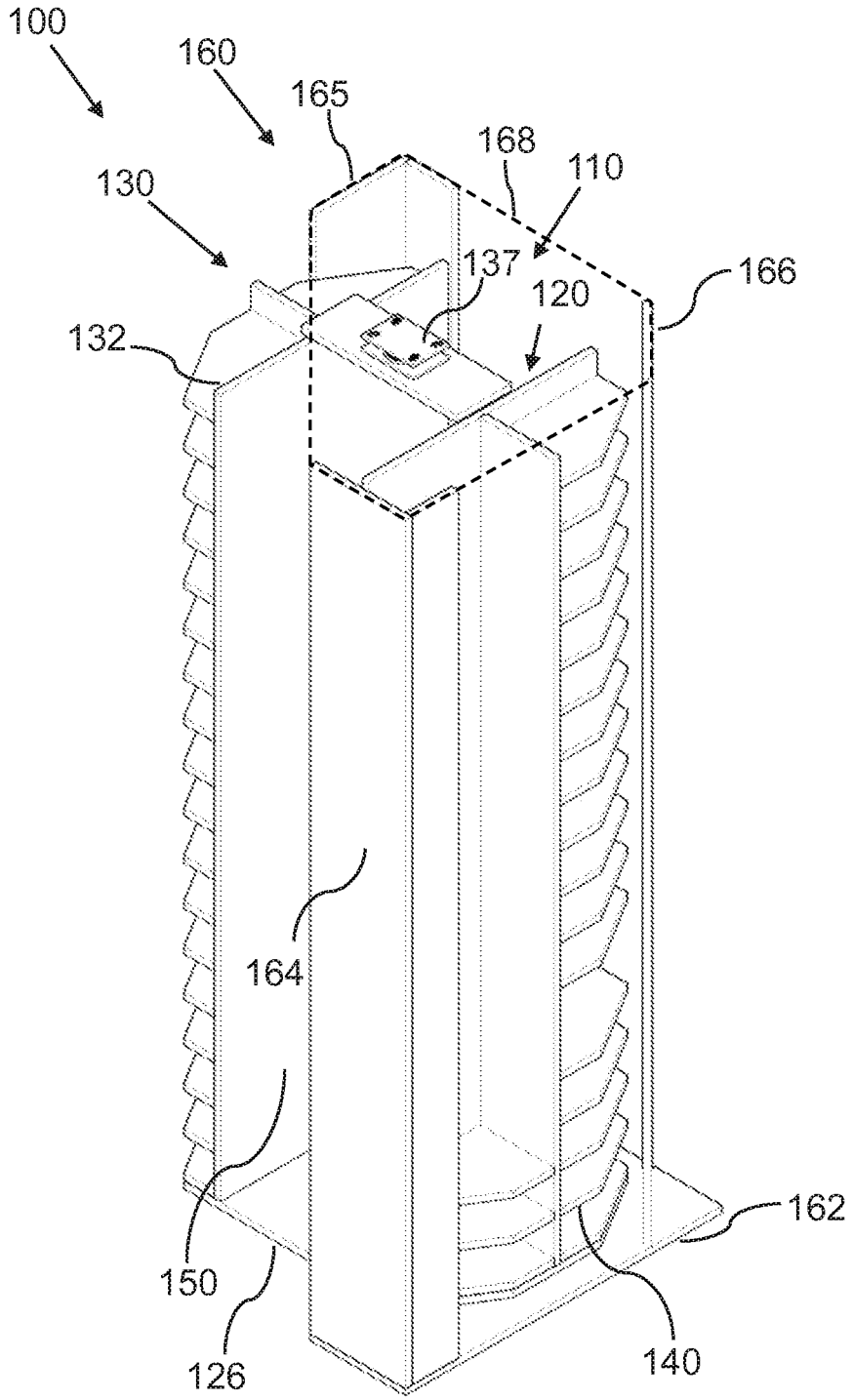
FIG. 2 shows a right side isometric view of a rotating storage cabinet for corner installation, according to an embodiment of the invention.

In a related embodiment, FIG. 2 shows a right side view of the embodiment shown in FIG. 1, wherein some shelves 140 have been removed.

Figure 3:
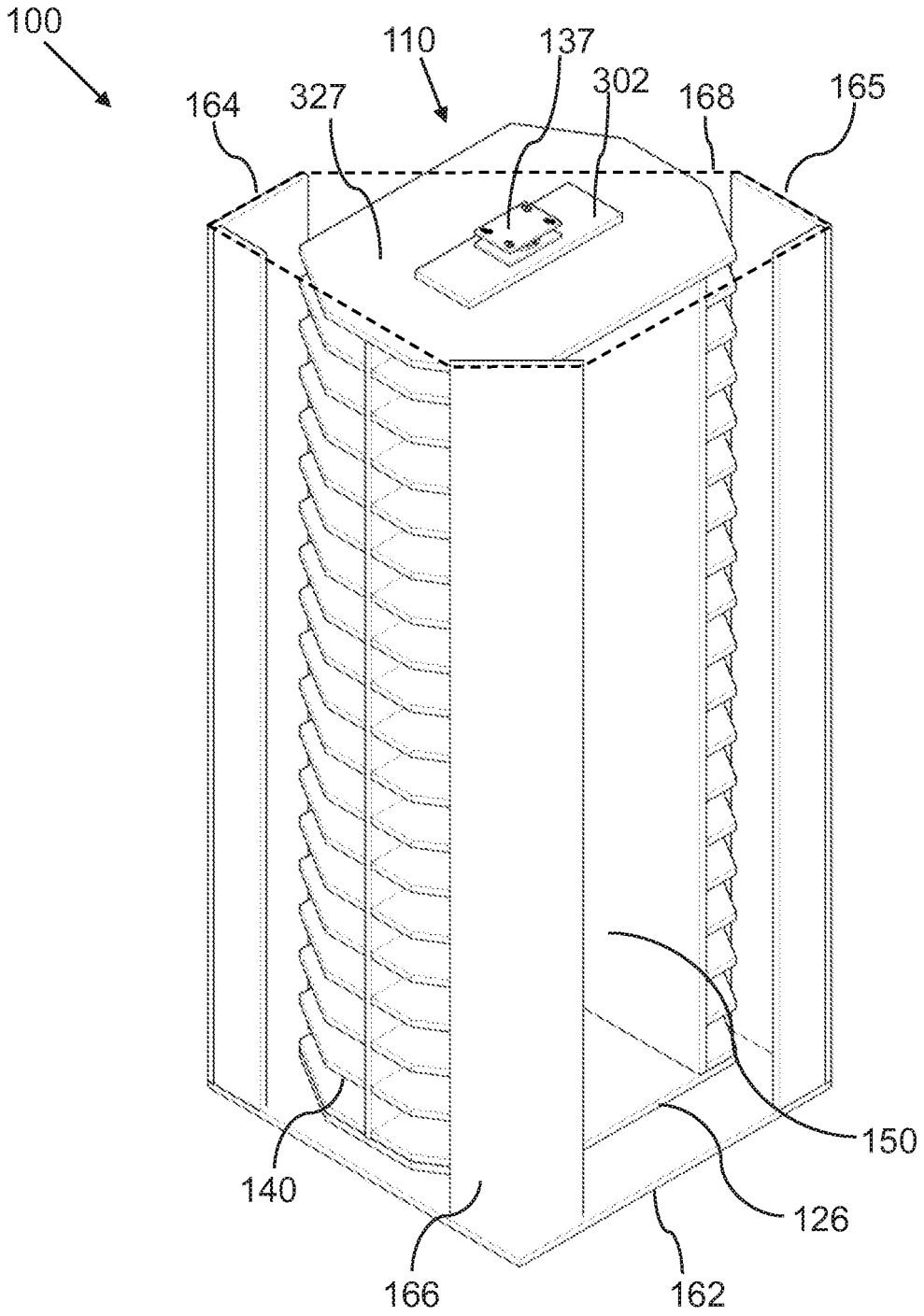
FIG. 3 shows a rear isometric view of a rotating storage cabinet for corner installation, according to an embodiment of the invention.

In a related embodiment, FIG. 3 shows a rear side view of the rotating storage cabinet 100, with an alternative design of the top inner mounting plate 327, such that it has the same shape and size as the bottom inner mounting plate 126 such that it fully covers the top of the inner cabinet 110. Optionally, a fitting piece 302 can be mounted between the top inner mounting plate 327 and the upper swivel 137, in order to adjust the height of the upper swivel 137.

Figure 4:
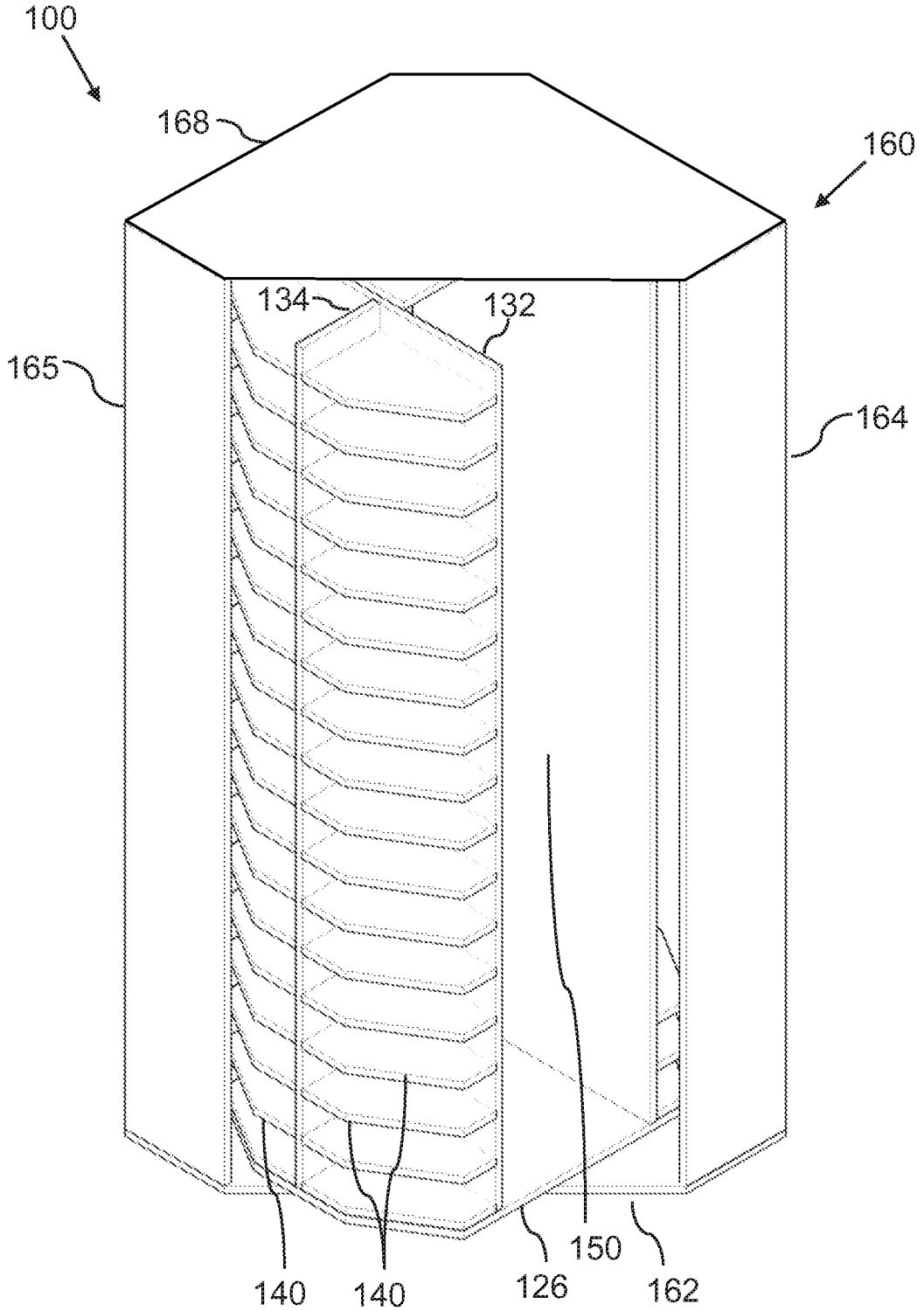
FIG. 4 shows a front isometric view of a rotating storage cabinet for corner installation, according to an embodiment of the invention.

In a related embodiment, FIG. 4 shows a front perspective view of the rotating storage cabinet 100 with the top enclosure board 168 mounted.

Figure 5:
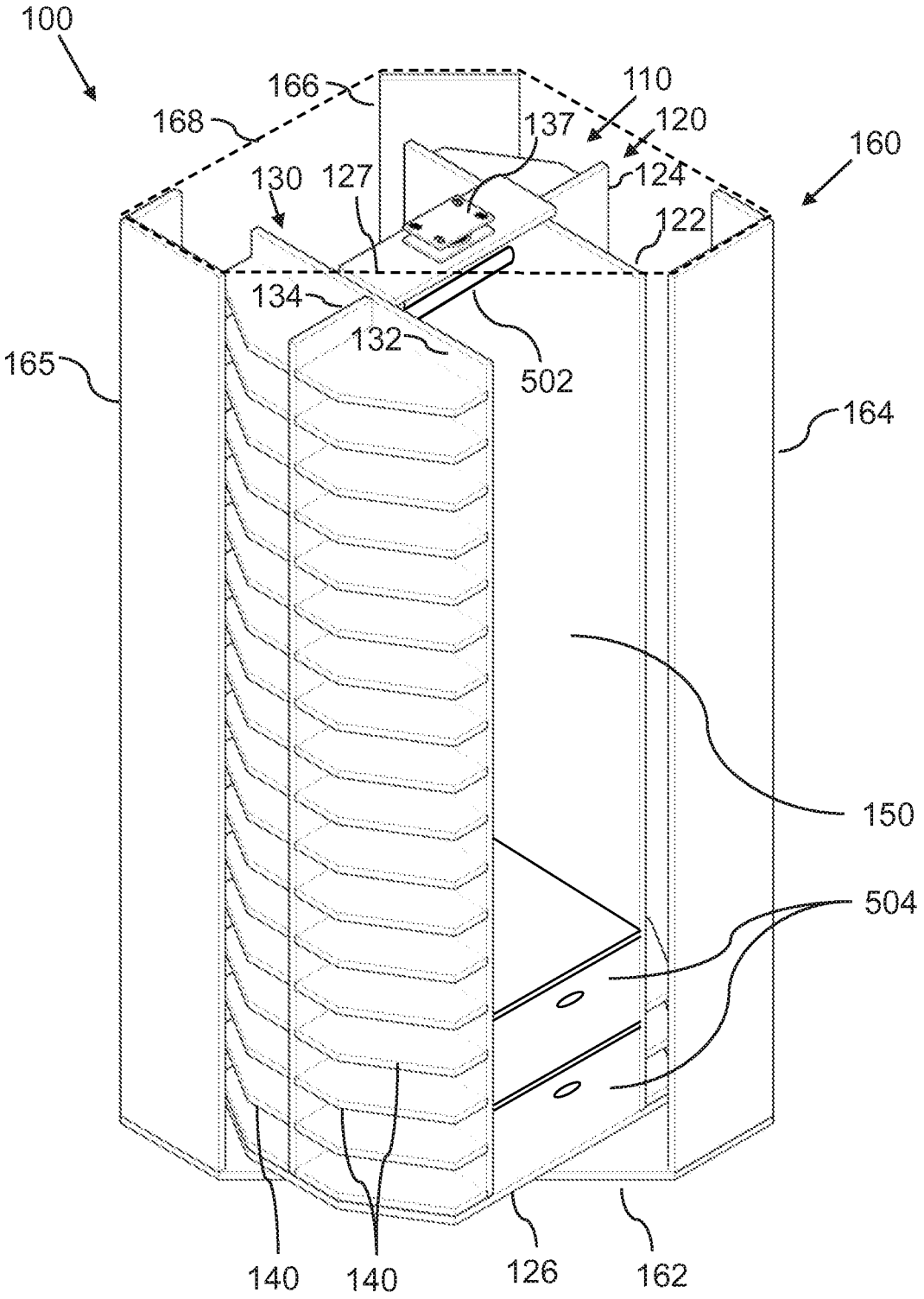
FIG. 5 shows a front isometric view of a rotating storage cabinet for corner installation, according to an embodiment of the invention.

In a related embodiment, as illustrated in FIG. 5, the inner cabinet 110 can further include:

a. A clothing bar 502, which can be mounted inside an upper end of the elongated central cavity 150, such that the clothing bar 502 is connected between the first and second t-plates 132 134, whereby coat hangers carrying clothing can hang from the clothing bar 502; and/or b. At least one drawer 504, such that the drawer is mounted in the central cavity 150, between the first and second t-plates 132 134.

Figure 6:
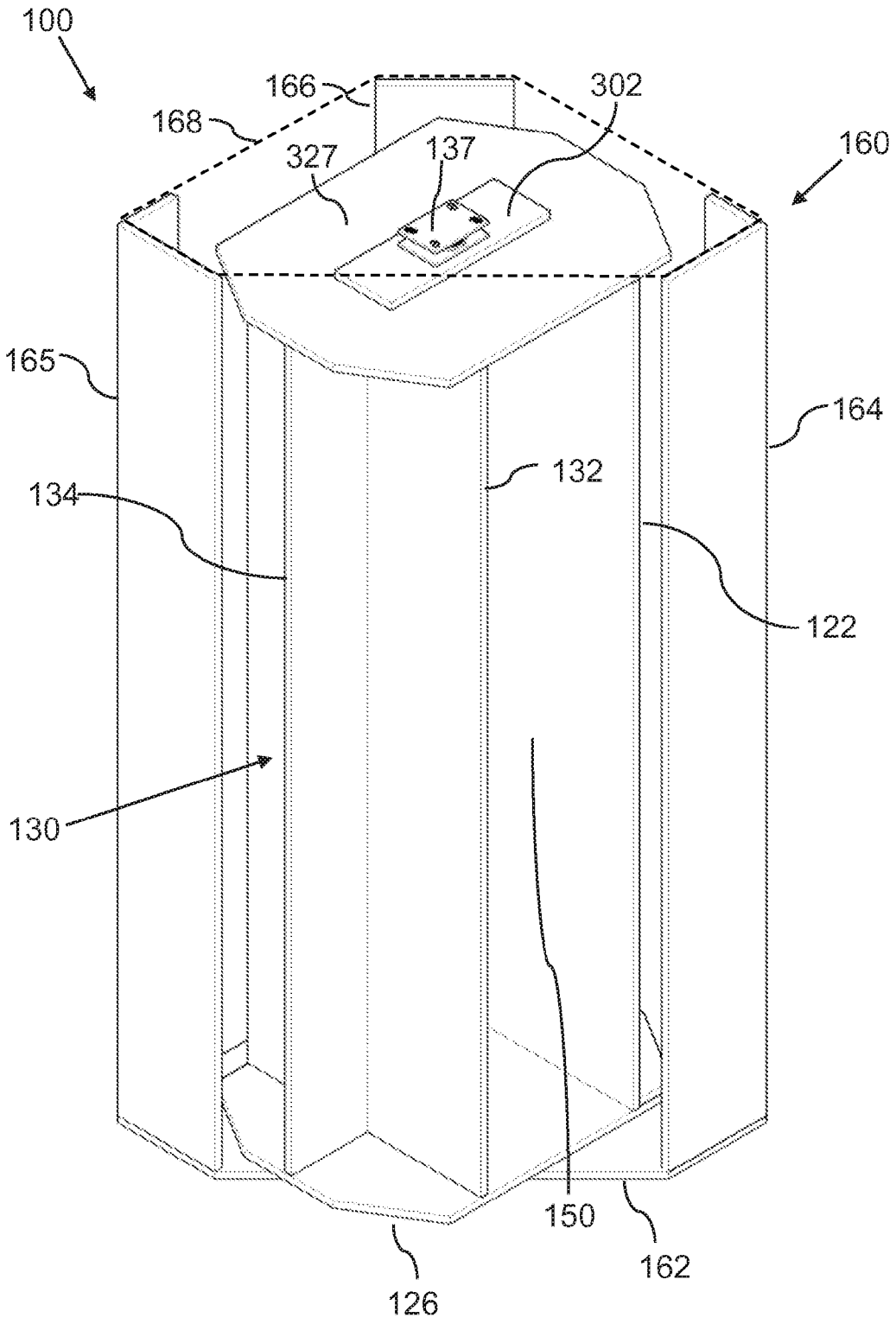
FIG. 6 shows a front isometric view of a rotating storage cabinet for corner installation, according to an embodiment of the invention.

In a related embodiment, FIG. 6 shows a front perspective view of the rotating storage cabinet 100 in a configuration without shelves 140, clothing bar 502, and drawers 504.

Figure 7:
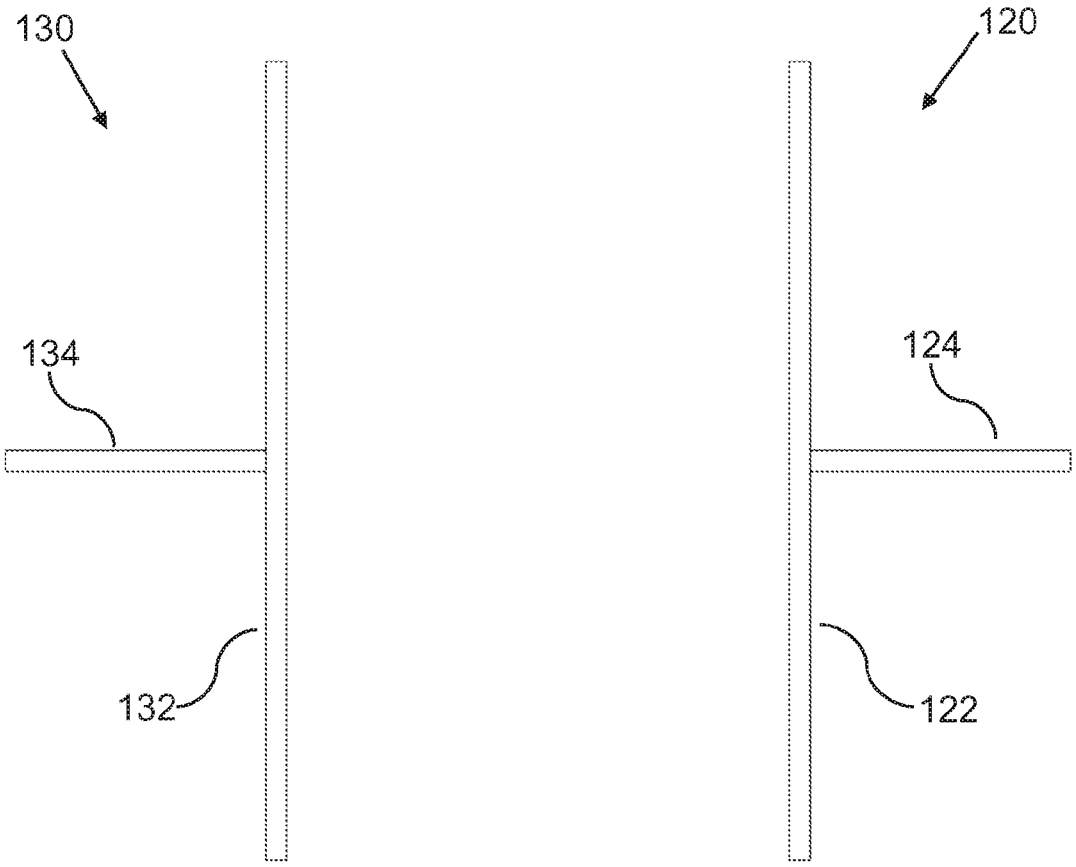
FIG. 7 shows a top view of opposing first and second t-frames, according to an embodiment of the invention.

In a related embodiment, FIG. 7 shows a top view of opposing first and second t-frames 120 130.

In a related embodiment, FIG. 8 shows a side view of the rotating storage cabinet for corner installation 100, showing the upper swivel 137 and the lower swivel 802.

In related embodiments, the lower swivel 802 can be manufactured with a rating in a 600-1800 pound load capacity range. Normally, the upper swivel 137 can be of a lighter construction, for example with a rating in a 200-600 pound capacity range. In some cases, though, the upper swivel 137 can have a similar or higher load capacity than the lower swivel.

In a related embodiment, the lower swivel 802 can be a heavy-duty 1,200 pound capacity turntable base.

In a related embodiment, the lower swivel 802 can have a higher load capacity than the upper swivel 137.

Figure 9:
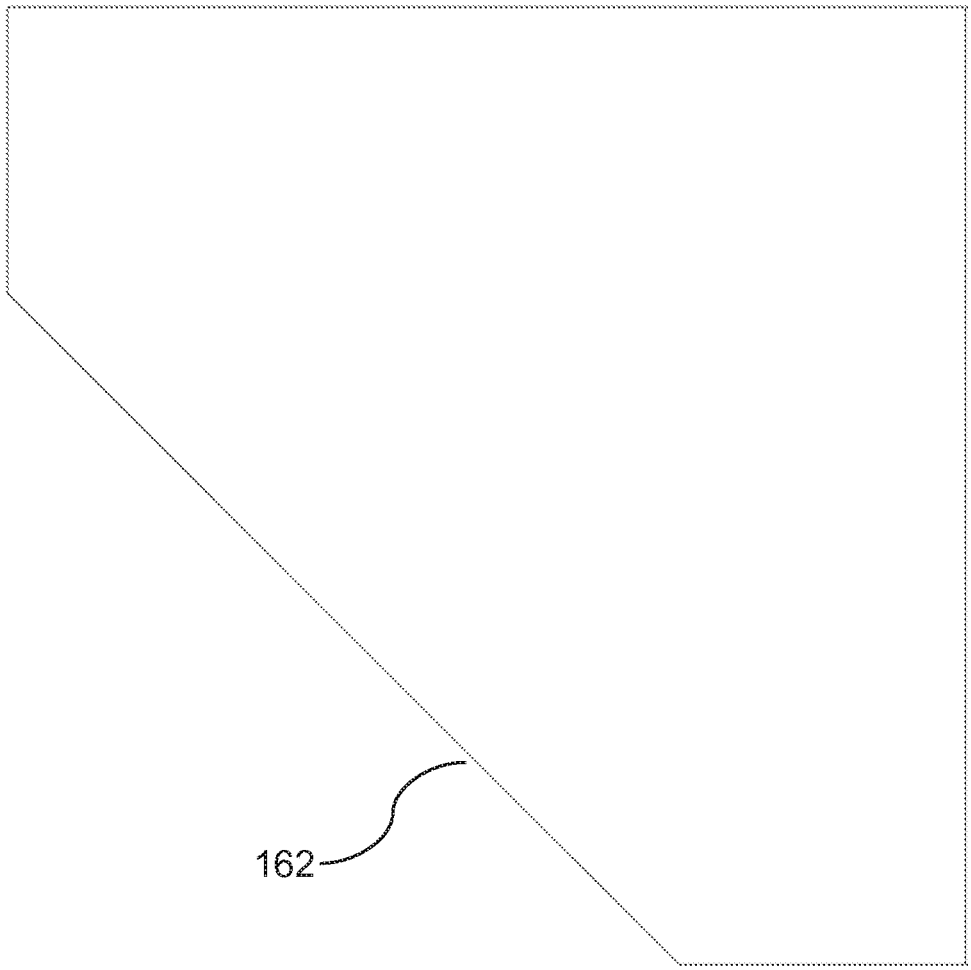
FIG. 9 shows a top view of a base enclosure board, according to an embodiment of the invention.

In a related embodiment, FIG. 9 shows a base enclosure board 162.

Figure 10:
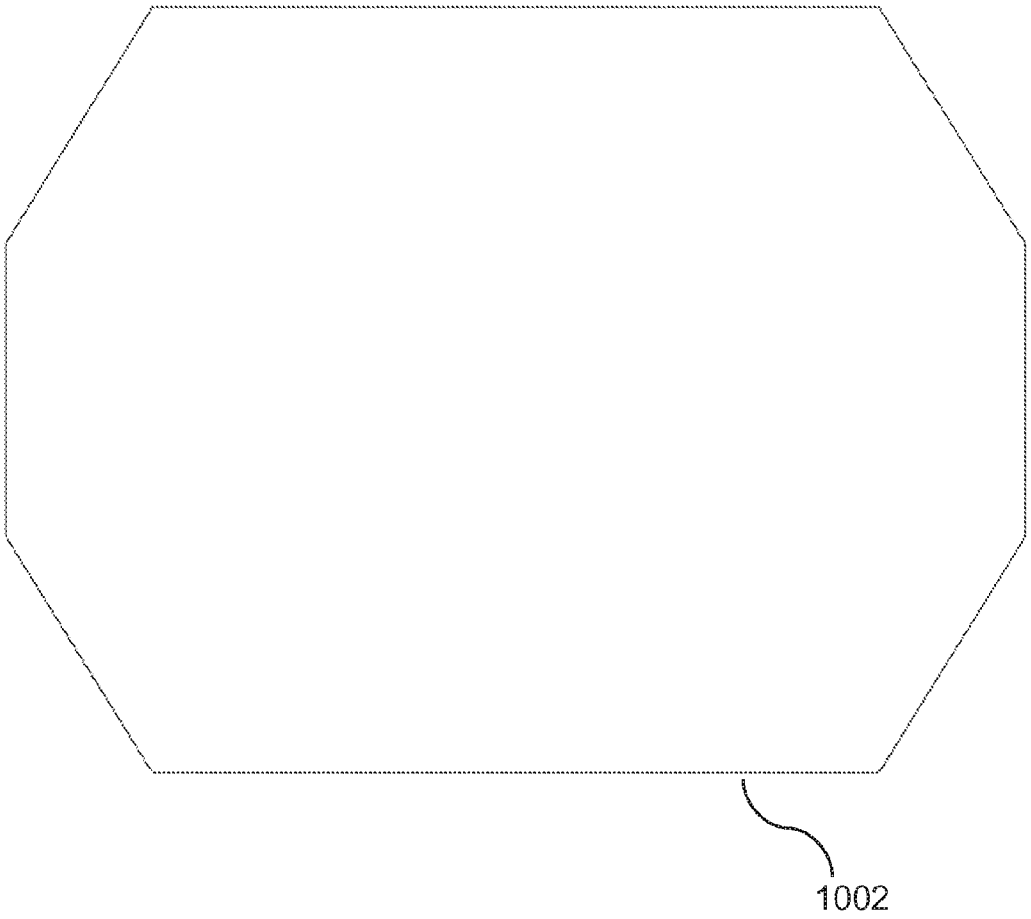
FIG. 10 shows a top view of an inner mounting plate, according to an embodiment of the invention.

In a related embodiment, FIG. 10 shows an inner mounting plate 1002, which can function as either a bottom inner mounting plate 126 or a top inner mounting plate 327.

Figure 11:
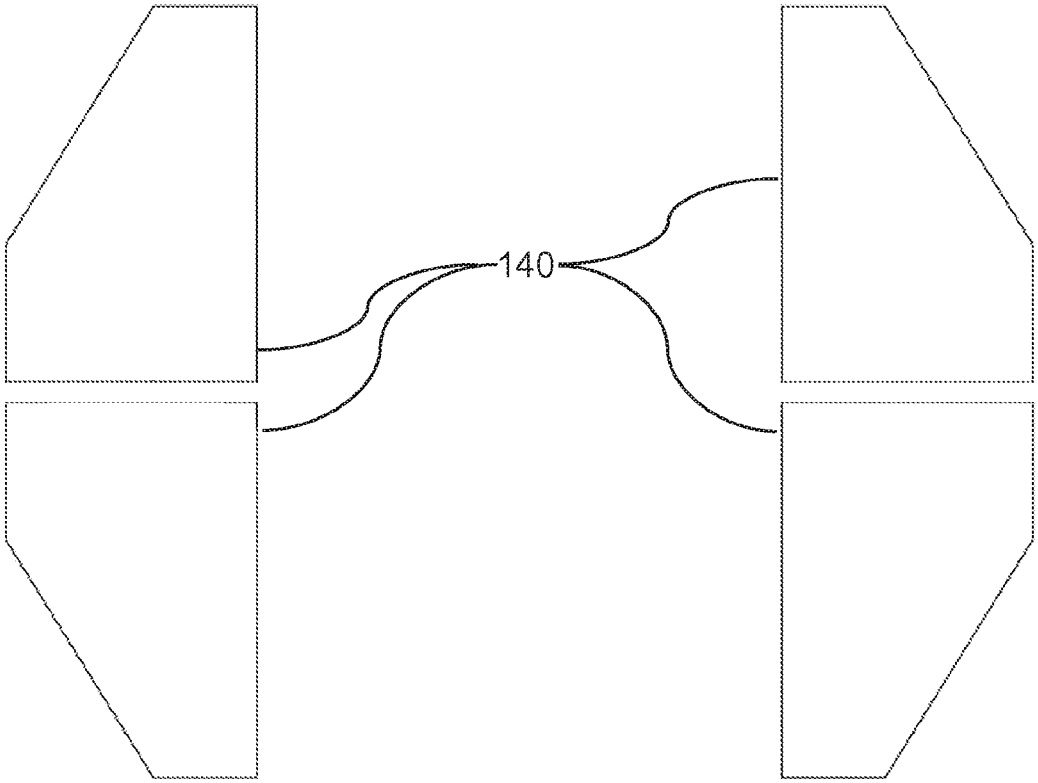
FIG. 11 shows a top view of shelves for installation in a rotating storage cabinet, according to an embodiment of the invention.

In a related embodiment, FIG. 11 shows shelves 140 for mounting on outer sides of the t-frame 120 130, in outward facing spaces between the t-plates 122 132 and the t-legs 124 134.

In related embodiments, the right and left side column can be in a plurality of different shapes, including an I-shape, or a u-shape, or a flat elongated board.

In related embodiments, the rotating storage cabinet 100 can be built from board materials commonly used for fabrication of cabinets, including melamine, wood, plywood or medium density fiberboard material, which can be connected with cam fittings or other commonly known fasteners, connectors, fitters, or adhesives.

Here has thus been described a multitude of embodiments of the rotating storage cabinet 100, which can be employed in numerous modes of usage.

The many features and advantages of the invention are apparent from the detailed specification, and thus, it is intended by the appended claims to cover all such features and advantages of the invention, which fall within the true spirit and scope of the invention.

Many such alternative configurations are readily apparent, and should be considered fully included in this specification and the claims appended hereto. Accordingly, since numerous modifications and variations will readily occur to those skilled in the art, it is not desired to limit the invention to the exact construction and operation illustrated and described, and thus, all suitable modifications and equivalents may be resorted to, falling within the scope of the invention.

What is claimed is:

1. A storage cabinet for corner installation, comprising:

a. an inner cabinet, further comprising:

i. a first t-frame, which is mounted as a vertical support column, such that the first t-frame further comprises:
an inward-facing first t-plate, connected with
an outward-facing first t-leg;

ii. a second t-frame, which is mounted as a vertical support column, such that the second t-frame further comprises:
an inward-facing second t-plate, connected with
an outward-facing second t-leg;

such that the first and second t-frames are mounted opposing, such that the outer surfaces of the first and second t-plates are parallel, with a predetermined width between the first and second t-plates, such that a vertical and elongated central cavity is created between the opposing first and second t-plates;

wherein the inner cabinet is rotationally mounted inside the storage cabinet;

wherein the inner cabinet further comprises a clothing bar, which is centrally mounted inside an upper end of the central cavity, such that the clothing bar is connected between the first and the second t-plates, wherein the central cavity is configured to accommodate clothing hanging from the clothing bar.

2. The storage cabinet for corner installation of claim 1, further comprising a bottom inner mounting plate, wherein the first and second t-frames are mounted to respectively first and second sides of the bottom inner mounting plate, wherein the first and second sides are opposing sides.

3. The storage cabinet for corner installation of claim 2, further comprising a top inner mounting plate, which is connected to the top of the first and second t-frames, such that the first and second t-frames are stabilized in position between the bottom inner mounting plate and the top inner mounting plate.

4. The storage cabinet for corner installation of claim 3, further comprising:

a. a cabinet enclosure, further comprising:

i. a base enclosure board;

ii. a top enclosure board;

iii. a support structure, which connects the base enclosure board with the top enclosure board;

such that the inner cabinet is rotationally mounted inside the cabinet enclosure.

5. The storage cabinet for corner installation of claim 4, wherein the support structure further comprises:

a. a right side column, which is vertically elongated;

b. a left side column, which is vertically elongated; and c. a rear column, which is vertically elongated;

wherein:

the right side column, is vertically mounted between a right side of the base enclosure board and a right side of the top enclosure board;

the left side column, is vertically mounted between a left side of the base enclosure board and a left side of the top enclosure board; and the rear column, is vertically mounted between a rear side of the base enclosure board and a rear side of the top enclosure board.

6. The storage cabinet for corner installation of claim 5, wherein the right and left side columns are substantially I-shaped.

7. The storage cabinet for corner installation of claim 4, further comprising a lower swivel, mounted between the bottom inner mounting plate and the base enclosure board.

8. The storage cabinet for corner installation of claim 4, further comprising an upper swivel, mounted between the top enclosure board and the top inner mounting plate.

9. The storage cabinet for corner installation of claim 4, wherein the base enclosure board comprises perpendicular rear sides.

10. The storage cabinet for corner installation of claim 1, further comprising shelves mounted on the first and second t-frames, such that the shelves are mounted on outer sides of the t-frames, in outward facing spaces between the t-plates and the t-legs.

11. The storage cabinet for corner installation of claim 1, wherein the inner cabinet further comprises at least one drawer, such that the drawer is mounted inside a lower end of the central cavity, between the first and the second t-plates.

12. A storage cabinet for corner installation, comprising:

a. an inner cabinet, further comprising:

i. a first vertical support column;

ii. a second vertical support column;

such that the first and second vertical support columns are mounted opposing, with a predetermined width between the first and second vertical support columns, such that a vertical and elongated central cavity is created between the opposing first and second vertical support columns;

wherein the inner cabinet is rotationally mounted inside the storage cabinet;

wherein the inner cabinet further comprises a clothing bar, which is centrally mounted inside an upper end of the central cavity, such that the clothing bar is connected between the first and the second vertical support columns, wherein the central cavity is configured to accommodate clothing hanging from the clothing bar;

wherein the first vertical support column is configured as a first t-frame, such that the first t-frame further comprises:
an inward-facing first t-plate, connected with
an outward-facing first t-leg; and wherein the second vertical support column is configured as a second t-frame, such that the second t-frame further comprises:
an inward-facing second t-plate, connected with
an outward-facing second t-leg;

such that the first and second t-frames are mounted opposing, such that the outer surfaces of the first and second t-plates are parallel, with the predetermined width between the first and second t-plates, such that the vertical and elongated central cavity is created between the opposing first and second t-plates.

13. The storage cabinet for corner installation of claim 12, further comprising a bottom inner mounting plate, wherein the first and second t-frames are mounted to respectively first and second sides of the bottom inner mounting plate, wherein the first and second sides are opposing sides.

14. The storage cabinet for corner installation of claim 13, further comprising a top inner mounting plate, which is connected to the top of the first and second t-frames, such that first and second t-frames are stabilized in position between the bottom inner mounting plate and the top inner mounting plate.

15. The storage cabinet for corner installation of claim 14, further comprising:

a. a cabinet enclosure, further comprising:

i. a base enclosure board;

ii. a top enclosure board;

iii. a support structure, which connects the base enclosure board with the top enclosure board;

such that the inner cabinet is rotationally mounted inside the cabinet enclosure.

16. The storage cabinet for corner installation of claim 15, wherein the support structure further comprises:

a. a right side column, which is vertically elongated;

b. a left side column, which is vertically elongated;

c. a rear column, which is vertically elongated;

wherein:

the right side column, is vertically mounted between a right side of the base enclosure board and a right side of the top enclosure board;

the left side column, is vertically mounted between a left side of the base enclosure board and a left side of the top enclosure board; and the rear column, is vertically mounted between a rear side of the base enclosure board and a rear side of the top enclosure board.

17. The storage cabinet for corner installation of claim 15, further comprising a lower swivel, mounted between the bottom inner mounting plate and the base enclosure board.

18. The storage cabinet for corner installation of claim 15, further comprising an upper swivel, mounted between the top enclosure board and the top inner mounting plate.

19. The storage cabinet for corner installation of claim 12, further comprising shelves mounted on the first and second t-frames, such that the shelves are mounted on outer sides of the t-frames, in outward facing spaces between the t-plates and the t-legs.

* * * * *